US012752335B2

(12) United States Patent
Knott, Jr.

(10) Patent No.: US 12,752,335 B2
(45) Date of Patent: Oct. 6, 2026

(54) WIRE MESH PRODUCTS AND MANUFACTURING SYSTEMS AND METHODS THEREFORE

(71) Applicant: Riverdale Mills Corporation, Northbridge, MA (US)

(72) Inventor: James M. Knott, Jr., Northbridge, MA (US)

(73) Assignee: Riverdale Mills Corporation, Northbridge, MA (US)

( * ) Notice: Subject to any disclaimer, the term of this patent is extended or adjusted under 35 U.S.C. 154(b) by 118 days.

(21) Appl. No.: 18/510,942

(22) Filed: Nov. 16, 2023

(65) Prior Publication Data

US 2024/0165692 A1 May 23, 2024

Related U.S. Application Data

(60) Provisional application No. 63/427,171, filed on Nov. 22, 2022.

(51) Int. Cl.

| | |
|---|---|
| ***B21F 27/10*** | (2006.01) |
| ***B21F 11/00*** | (2006.01) |
| ***B21F 27/12*** | (2006.01) |

(52) U.S. Cl.

CPC ..... *B21F 27/10* (2013.01); *B21F 11/00* (2013.01); *B21F 27/12* (2013.01)

(58) Field of Classification Search

None

See application file for complete search history.

(56) References Cited

FOREIGN PATENT DOCUMENTS

| | | | | | |
|---|---|---|---|---|---|
| CN | 110125290 | A | | 8/2019 | |
| CN | 111482539 | A | * | 8/2020 | ..... B21F 27/005 |
| JP | H06226388 | A | | 8/1994 | |
| KR | 20090057505 | A | | 6/2009 | |
| KR | 20110126030 | A | | 11/2011 | |
| WO | 2021199095 | A1 | | 10/2021 | |
| WO | 2021209304 | A1 | | 10/2021 | |

OTHER PUBLICATIONS

Combined Search and Examination Report under Sections 17 and 18(3) issued by the Intellectual Property Office in related Great Britain Patent Application No. GB2317840.3 on May 21, 2024, 7 pages.

* cited by examiner

*Primary Examiner* — Daniel J. Schleis

(74) *Attorney, Agent, or Firm* — Gesmer Updegrove LLP

(57) ABSTRACT

A wire-mesh is disclosed that is formed of wires in a warp direction bonded to wires in a fill direction that is mutually orthogonal with respect to the warp direction, wherein the wire-mesh includes at least one gap that extends in any of the warp direction or the fill direction, the gap being formed of mutually-contiguous breaks in any of the warp direction wires and the fill direction wires, the gap facilitating separation of the wire-mesh.

16 Claims, 12 Drawing Sheets

WIRE MESH PRODUCTS AND MANUFACTURING SYSTEMS AND METHODS THEREFORE

PRIORITY

The present application claims priority to U.S. Provisional Patent Application 63/427,171 filed Nov. 22, 2022, the disclosure of which is hereby incorporated by reference in its entirety.

BACKGROUND

The invention generally relates to wire processing and relates specifically to the manufacturing of mesh, grill, netting, fencing, gauze and cloth, from iron or steel wire (collectively referred to hereafter as "Wire Mesh").

Wire Mesh rolls and panels can be manufactured by placing line (warp) wires and cross (fill) wires onto a grid and welding them at the point where the wires intersect. Wire Mesh is manufactured in a process that results in strands of individual wire being constructed into rolls or panels of Wire Mesh. Wire Mesh can be manufactured in various lengths and widths, as dictated by the operator inputs. Once manufactured, the Wire Mesh rolls or panels may be sold as is, or subjected to further processing, e.g., application of corrosion inhibitors, coated, etc., or cut into smaller rolls and panels, depending upon its intended use. Wire Mesh may be used for any of a wide variety of uses, including industrial applications such as high security fencing, land management, livestock pens and caging, farming applications and marine use, to name but a few.

Various applications require panels and rolls of different sizes for fabricating various structures and products. Panels can be manufactured individually but are more often cut from a stock of larger panels, or from a roll.

Smaller width rolls or panels can be manufactured utilizing a large width Wire Mesh welding machine, but such Wire Mesh production underutilizes the potential manufacturing capacity of the welding apparatus, and is therefore inefficient. The inefficiency stems from the fact that a single smaller width roll or panel manufactured individually would still require the same production time, man hours, energy and wear and tear ("Wastage"), on the Wire Mesh welding machine as multiple rolls or panels manufactured simultaneously as a connected roll or connected panel. This principle can be extrapolated out for each additional post production manufacturing process to add additional value to the finished product, e.g., application of corrosion inhibitors, coated, etc. As a result, each additional step in the post production manufacturing process compounds the Wastage of processing a single smaller width roll or panel, as opposed to multiple smaller width rolls or panels as a connected roll or connected panel and is therefore highly inefficient.

Therefore, there remains a need for a more efficient and economical system and method for manufacturing multiple smaller width Wire Mesh rolls or panels simultaneously.

SUMMARY

In accordance with an aspect, the invention provides a wire-mesh formed of wires in a warp direction bonded to wires in a fill direction that is mutually orthogonal with respect to the warp direction, wherein the wire-mesh includes at least one gap that extends in any of the warp direction or the fill direction, the gap being formed of mutually-contiguous breaks in any of the warp direction wires and the fill direction wires, the gap facilitating separation of the wire mesh.

In accordance with another aspect, the invention provides a wire processing system for providing manufactured Wire Mesh. The wire processing system includes an input end for receiving a plurality of line wires in a machine direction, a cross-direction input station for providing a cross wire, a welding station for receiving the cross wire and the plurality of line wires, said welding station providing that the cross wire is welded to the plurality of line wires, forming a Wire Mesh, an advancing system for advancing the Wire Mesh in the machine direction, providing that, additional cross wires may be introduced to the Wire Mesh and welded at the welding station, and a selective cutting system for selectively cutting a plurality of wires in the Wire Mesh as it moves in the machine direction, the plurality of cuts demarking distinct panels that may be readily separated from one another following processing.

In accordance with a further aspect, the invention provides a method of processing wire for providing manufactured Wire Mesh. The method includes receiving a plurality of line wires in a machine direction, providing a cross wire to a welding station in a cross-machine direction, welding the cross wire to the plurality of line wires, forming a Wire Mesh, advancing the Wire Mesh in the machine direction, providing that additional cross wires may be introduced to the Wire Mesh and welded at the welding station, and selectively cutting a plurality of wires in the Wire Mesh as it moves in the machine direction, the plurality of cuts demarking distinct panels that may be readily separated from one another following processing.

BRIEF DESCRIPTION OF THE DRAWINGS

The following description may be further understood with reference to the accompanying drawings in which.

The drawings are shown for illustrative purposes only.

DETAILED DESCRIPTION

The invention provides a wire processing system for manufacturing Wire Mesh, whether created as a panel, or by a continuous wire processing system. Where formed by continuous wire processing, the system includes an input for receiving a plurality of strands of line wire in a machine direction, and an input for receiving a strand of cross wire at a welding station The wire mesh is welded and the system includes an advancing system for advancing the Wire Mesh in the machine direction, providing that additional cross-direction strands of wire may be introduced to the Wire Mesh and welded at the welding station The system also includes a selective cutting system for cutting a plurality of links in the Wire Mesh as it moves in the machine direction, the plurality of cut links demarking a plurality of wire rolls or panels that may be readily separated from one another following processing, and further includes a receiving area for receiving the Wire Mesh in roll form.

Figure 1:
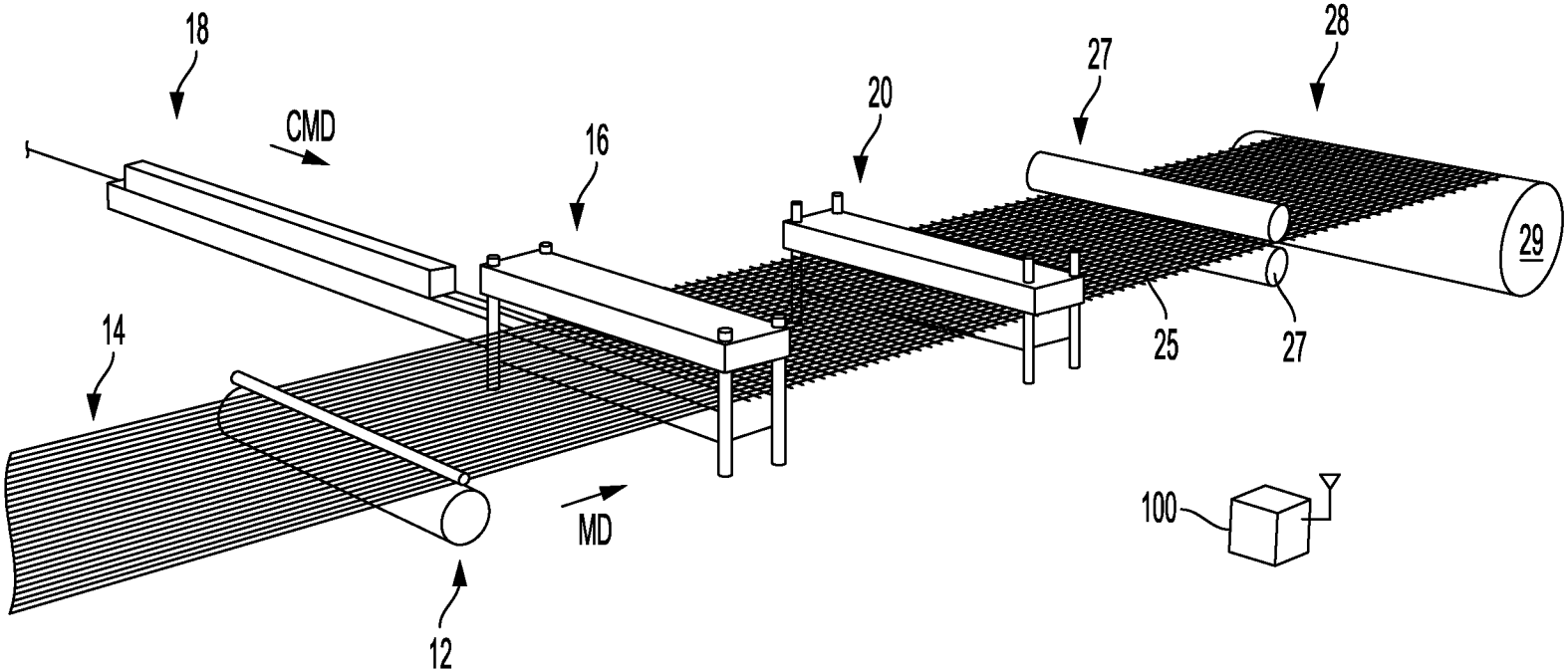
FIG. 1 shows an illustrative diagrammatic view of a wire processing system in accordance with an aspect of the present invention.

FIG. 1 shows a wire processing system (10) that includes an input station (12) at which a plurality of line wires (14) are fed into the system. At a welding station (16), a cross wire is put into the system in a cross-machine direction (or fill direction) (18) forming a Wire Mesh (25). Following the welding station, the Wire Mesh passes through a selective cutting system (20).

The Wire Mesh (25) is advanced through the system (10) by an advancing system (27) that moves the Wire Mesh (25) in the machine direction (MD). All systems and stations operate under the control of one or more computer processing systems (100). The Wire Mesh (25) exits the system (10) at a receiving area (28) that may include a collecting roller (29). The wires (14) may be ferrous or non-ferrous, and may be cold drawn and/or annealed and coated or uncoated.

Figure 2A:
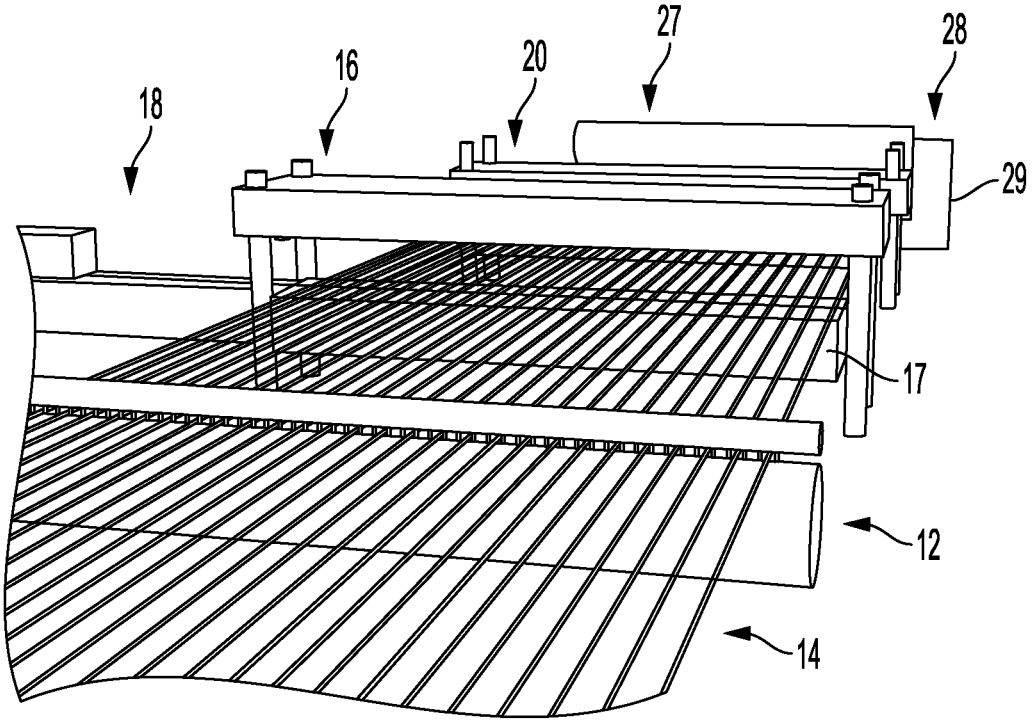
FIGS. 2A and 2B show illustrative diagrammatic enlarged views of a welding station and a cross-direction input station, showing a cross wire is not yet fed (FIG. 2A) and showing the cross wire fed over the plurality of wires (FIG. 2B)
Figure 2B:
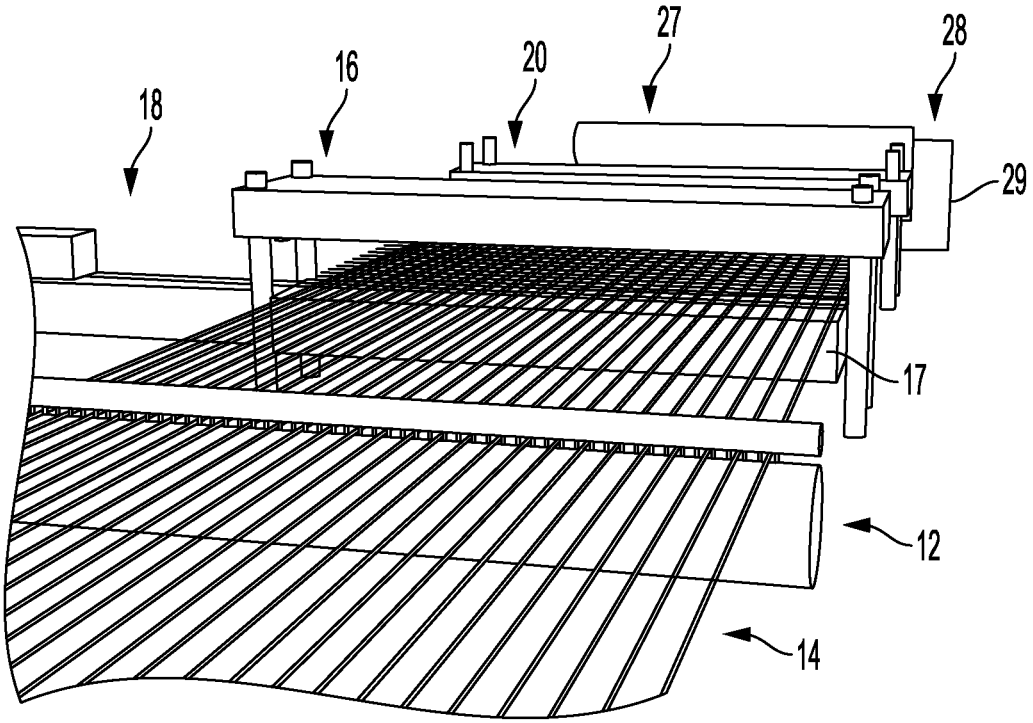

FIG. 2A shows the welding station (16) and cross-direction input station (18) where a cross wire (32) is positioned on a feeder (30) to be fed over the plurality of line wires (14). FIG. 2A shows the end (34) of the cross wire (32) at the end of the feeder (30), and FIG. 2B shows the end (34) of the cross wire (32) at the far side of the plurality of line wires (14) having been fed across them.

Figure 3A:
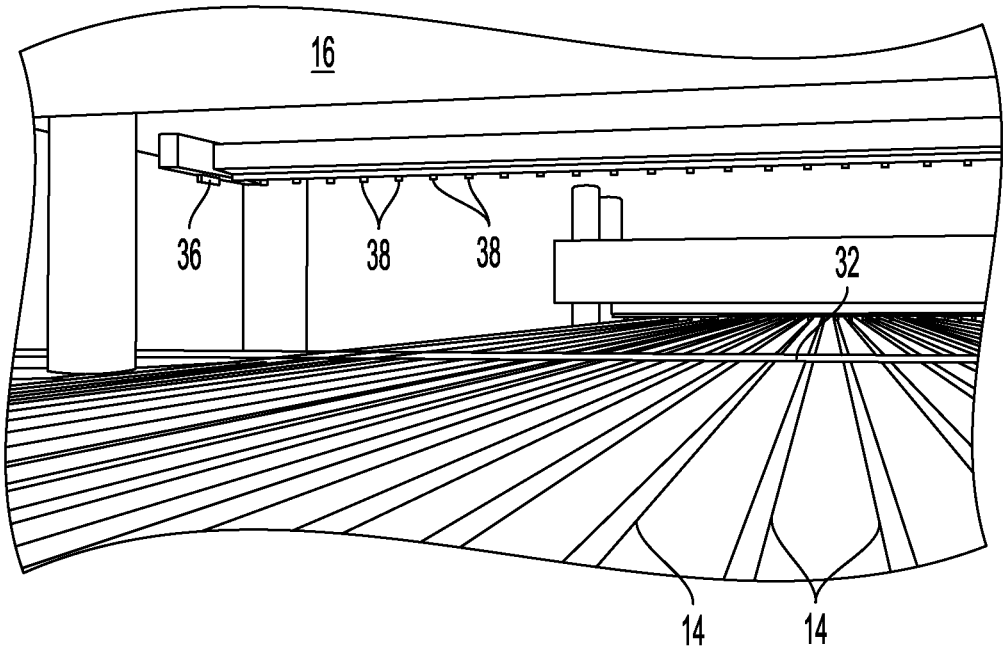
FIGS. 3A and 3B show illustrative diagrammatic enlarged views of the welding station that includes a cross wire cutting blade, showing the cross wire fed over the plurality of wires (FIG. 3A) and showing the cross wire being cut and welded (FIG. 3B)
Figure 3B:
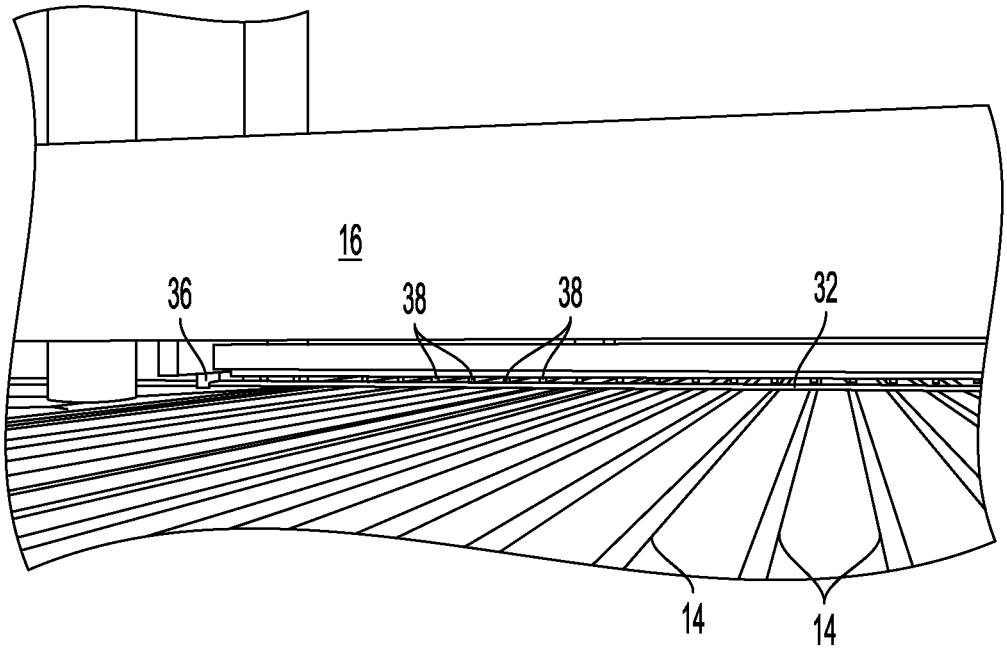
Figure 4A:
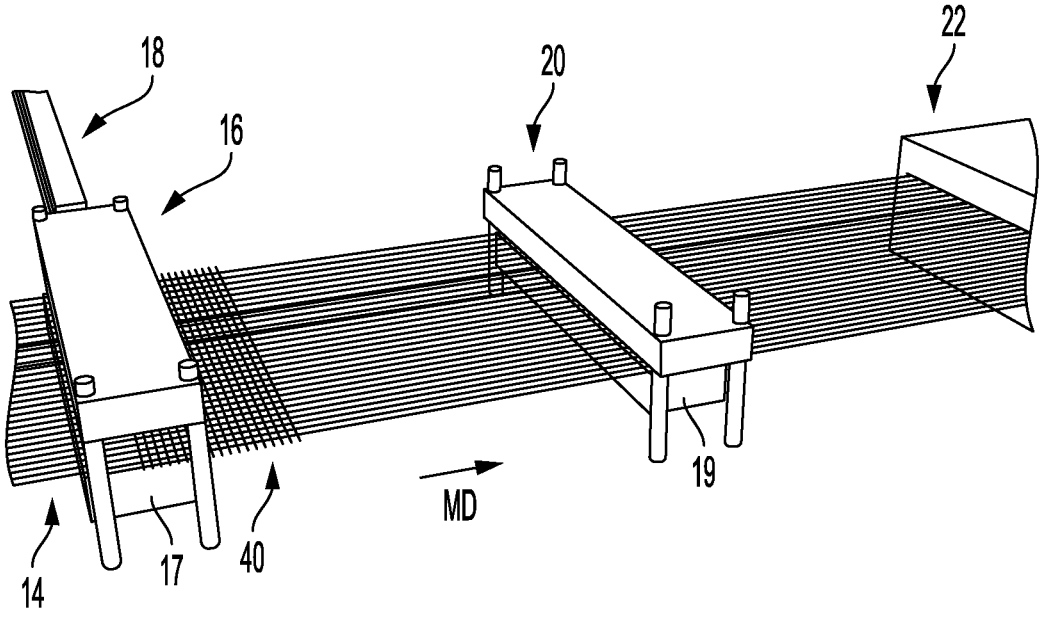
FIGS. 4A and 4B show illustrative diagrammatic views of the system of FIG. 1 with the wire mesh beginning for form (FIG. 4A) and becoming more formed in the machine direction (FIG. 4B)
Figure 4B:
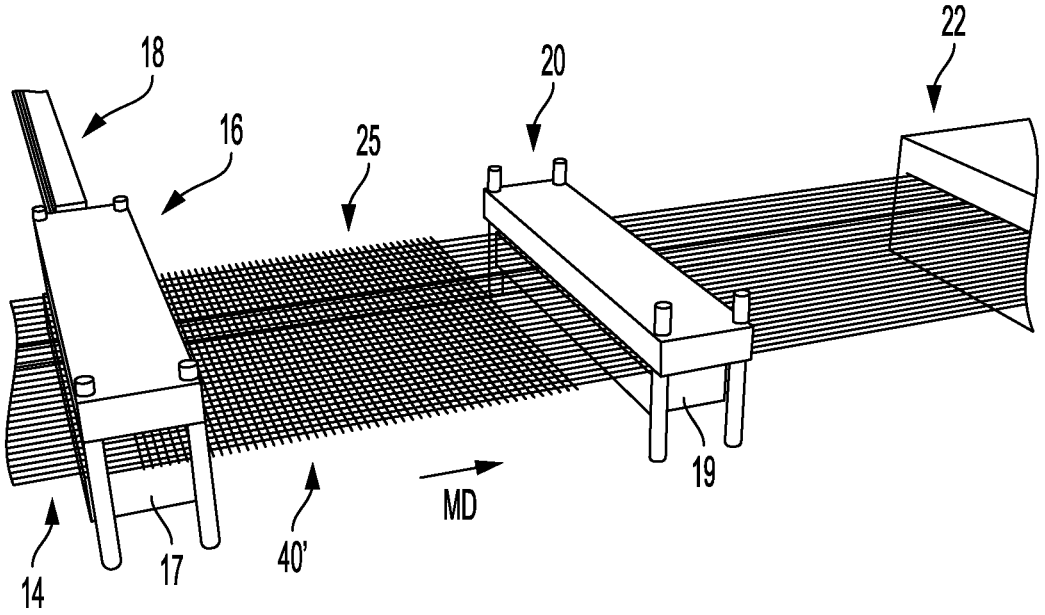

FIG. 3A shows the welding station (16) including a cross wire cutting blade (36) and a plurality of welding elements (38) that perform welds at the junctions of the cross wires (32) and the line wires (14). FIG. 3B shows the blade (36) and welding elements (38) lowered onto the wire (32) (e.g., pressing the wires (14, 32) against a base (17) (as shown in FIGS. 2A and 2B)). The plurality of line wires (14) are advanced (e.g., by the advancing system (27)), and subsequent cross wires are similarly welded to the plurality of line wires (14), forming the Wire Mesh (25). FIG. 4A shows the Wire Mesh (25) beginning to form (40), and FIG. 4B shows the Wire Mesh (25) a short time later having grown in the machine direction (40').

Figure 5A:
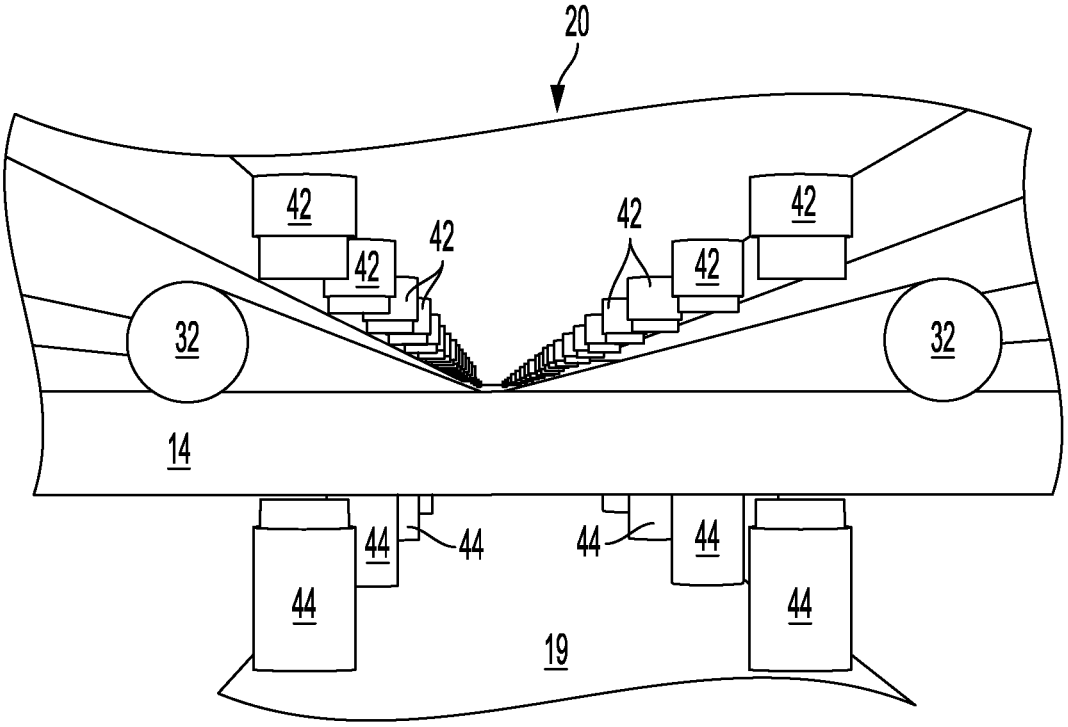
FIGS. 5A and 5B show illustrative diagrammatic enlarged views of a cross wire cutting station showing the cutting blades not engaged (FIG. 5A) and showing the cutting blades engaged with a cross wire (FIG. 5B)
Figure 5B:
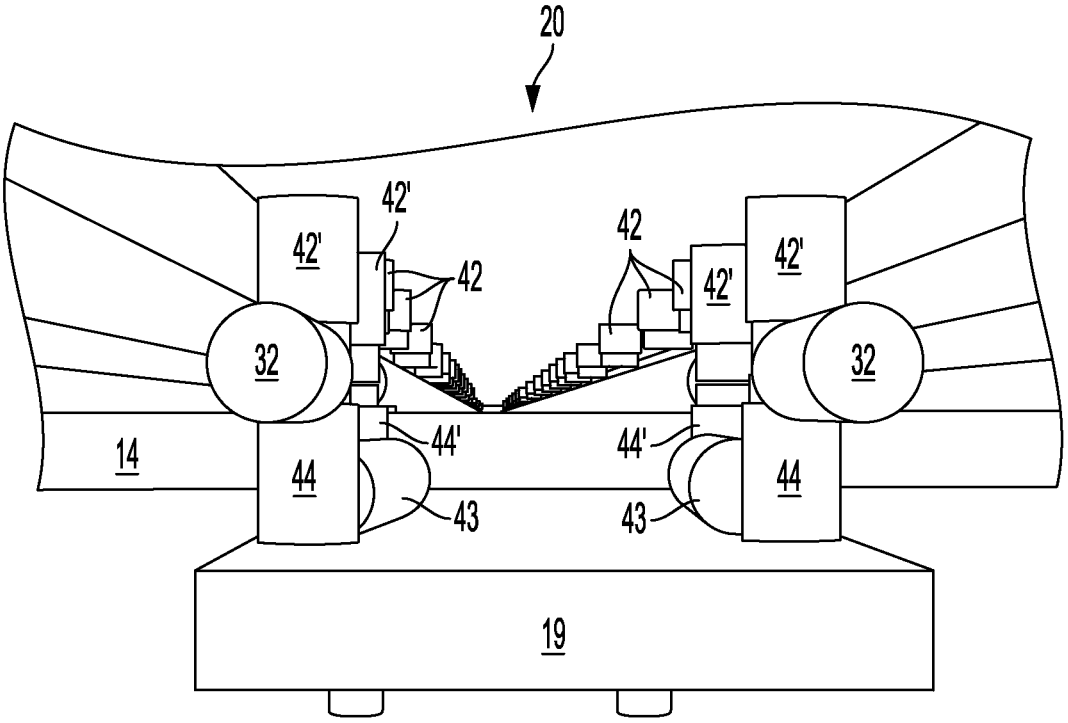
Figure 6:
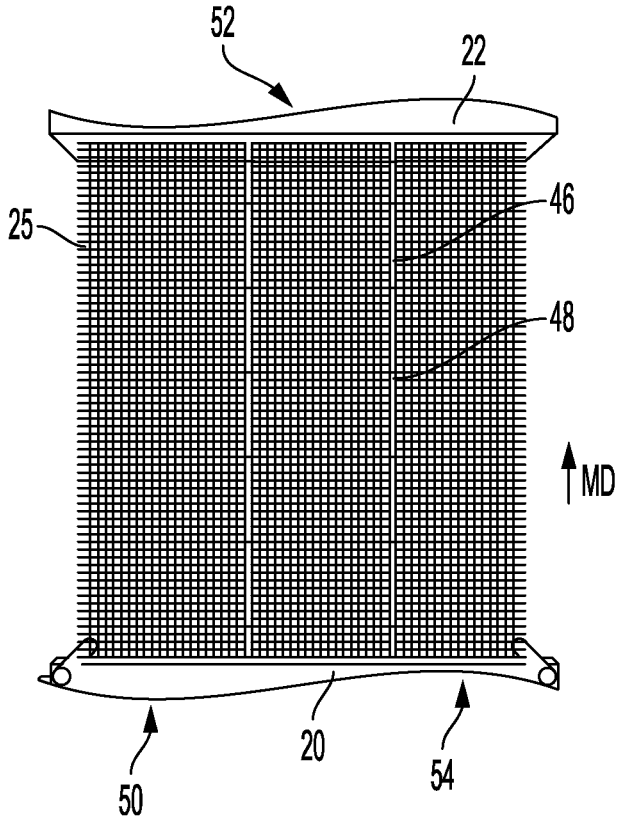
FIG. 6 shows an illustrative diagrammatic view of a section of a wire mesh with sections of cross wires removed.
Figure 7:
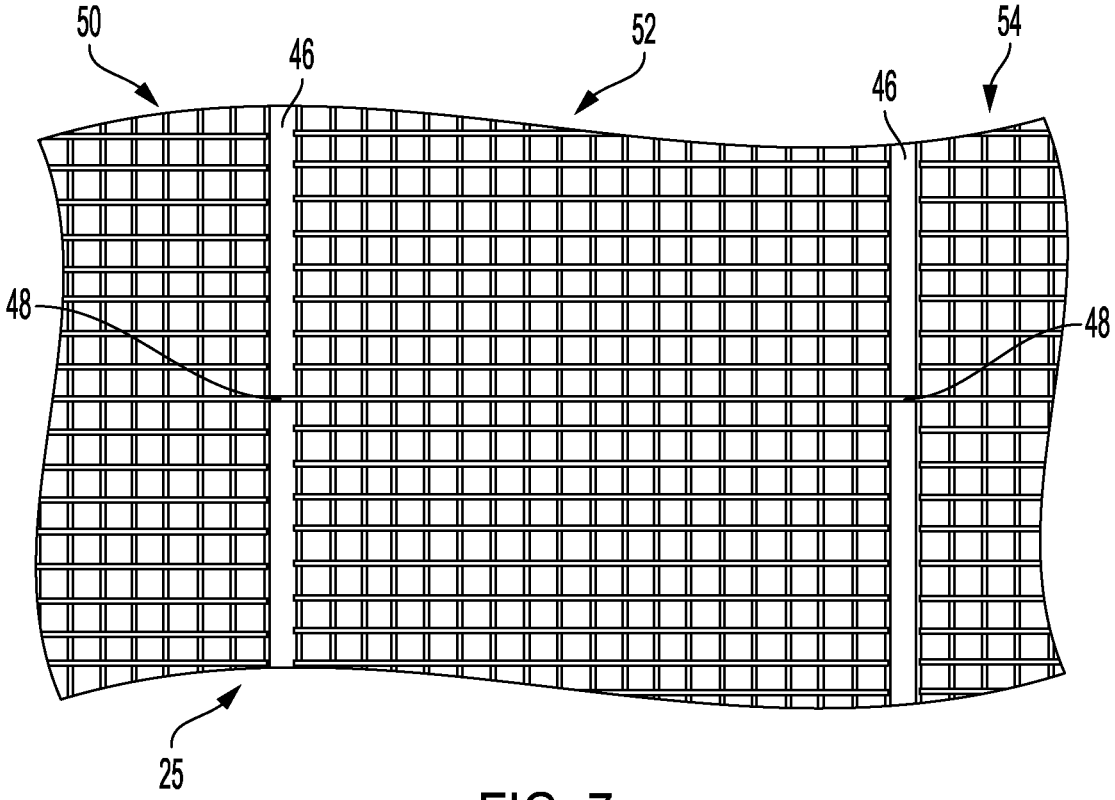
FIG. 7 shows an illustrative diagrammatic enlarged view of a portion of the wire mesh of FIG. 6.

The cutting system includes a plurality of individually actuatable cutting members that may be selected to cut any of the line wires (14) or cross wires (32). FIG. 5A shows a plurality of upper cutting members (42) and lower cutting members (44) within the cutting system (20) for selectively cutting sections of any of the cross wires (32). FIG. 5B shows the selected upper and lower cutting members (42', 44') as actuated to thrust cutting blades into the cross wire (32) such that a section (43) of the wire is removed from the Wire Mesh. With reference to FIG. 6, as the Wire Mesh (25) advances in the machine direction, adjacent cross wires may be similarly processed, causing gaps (46) in the Wire Mesh to be created that define panels (50, 52, 54). The system may include individually selectable cutting members for cutting one or more sections (43) (two are shown being cut using four cutting members in FIG. 5B). Certain cross wires may remain uncut (48) to hold the panels (50, 52, 54) together for processing. FIG. 7 shows an enlarged view of a portion of the Wire Mesh (25) shown in FIG. 6.

Figure 8A:
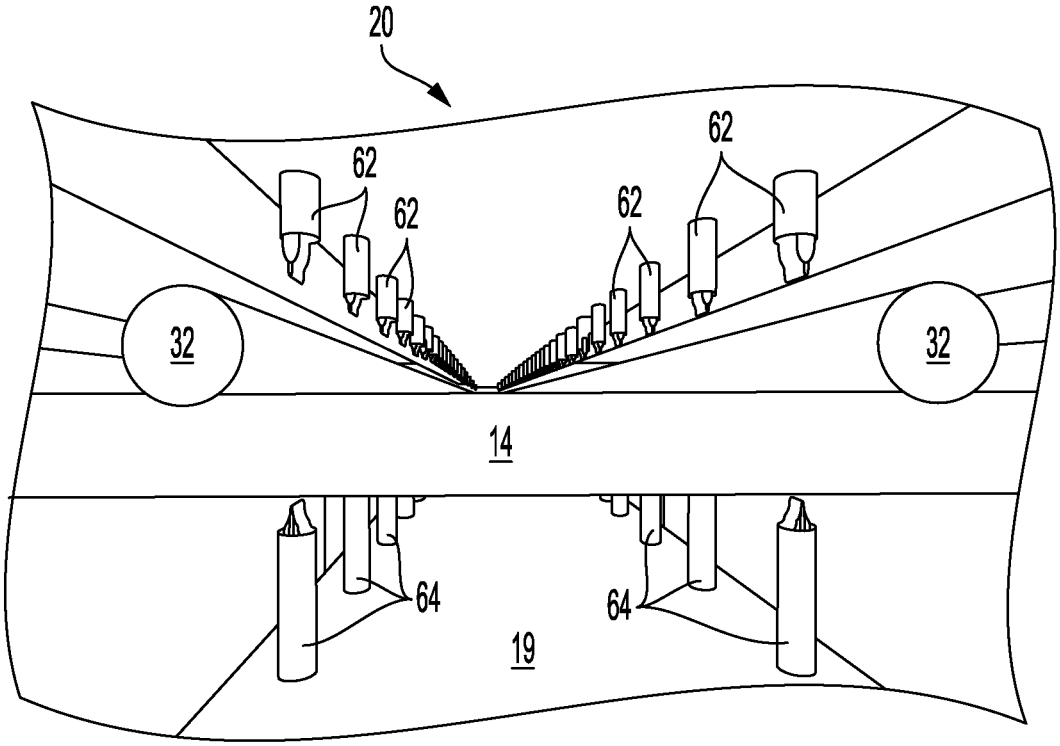
FIGS. 8A and 8B show illustrative diagrammatic enlarged views of a line wire cutting station showing the cutting blades not engaged (FIG. 8A) and showing the cutting blades engaged with a line wire (FIG. 8B)
Figure 8B:
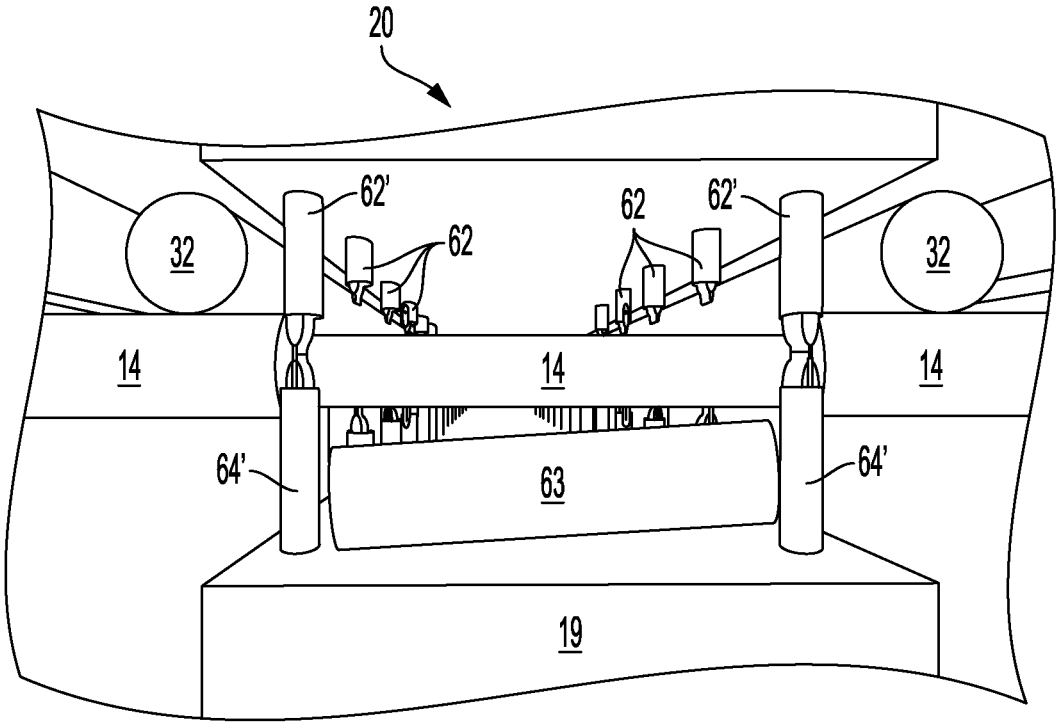
Figure 9:
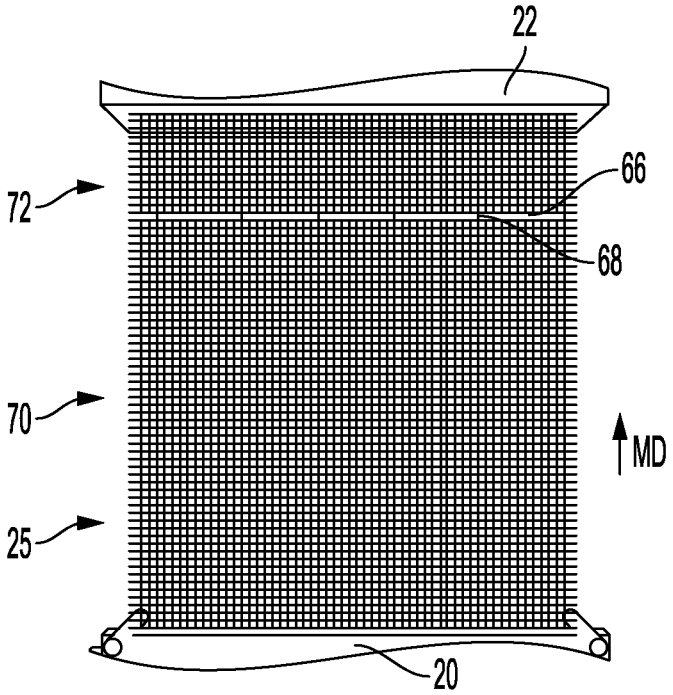
FIG. 9 shows an illustrative diagrammatic view of a section of a wire mesh with sections of line wires removed.
Figure 10:
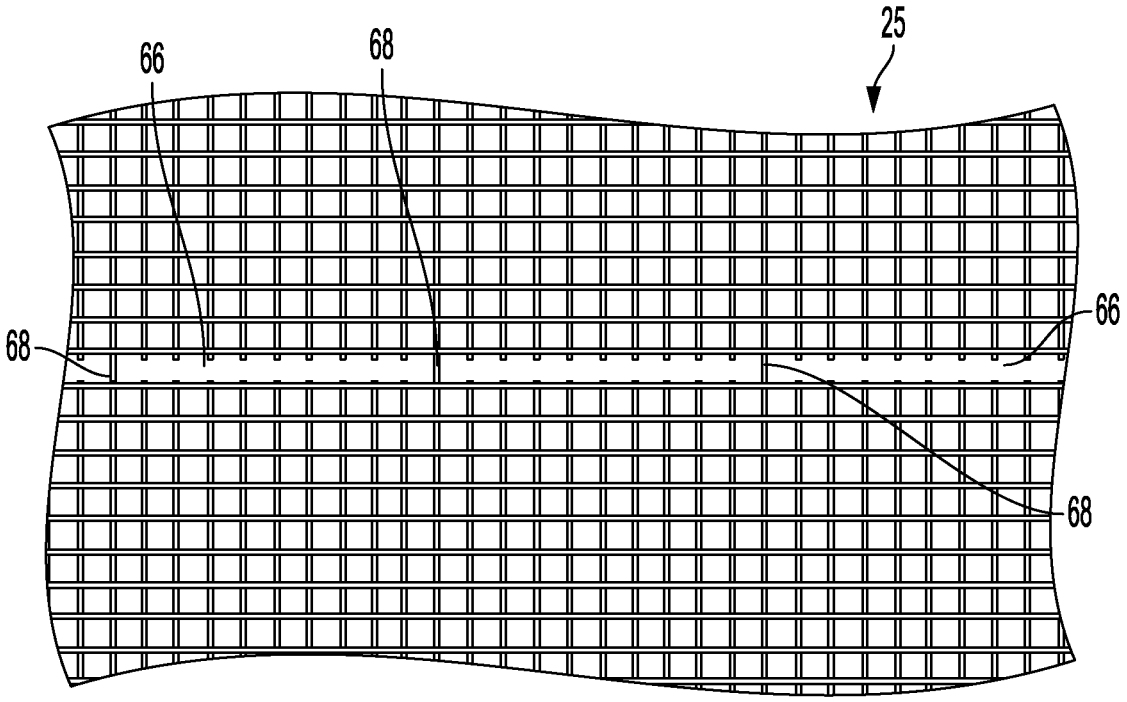
FIG. 10 shows an illustrative diagrammatic enlarged view of a portion of the wire mesh of FIG. 9.

FIG. 8A shows a plurality of upper cutting members (62) and lower cutting members (64) within the cutting system (20) for selectively cutting sections of any of the line wires (14). FIG. 8B shows the selected upper and lower cutting members (62', 64') as actuated to thrust cutting blades into the line wire (14) such that a section (63) of the wire is removed from the Wire Mesh. With reference to FIG. 9, as the Wire Mesh (25) advances in the machine direction, other sections of the line wires may be similarly processed, causing gaps (66) in the Wire Mesh to be created that thereby define panels (70, 72). Again, the system may include individually selectable cutting members for cutting one or more sections (63) (one is shown being cut using two cutting members in FIG. 8B). Certain of the machine direction strands of wire may remain uncut (68) to hold the panels (70, 72) together for processing. FIG. 10 shows an enlarged view of a portion of the Wire Mesh (25) shown in FIG. 9. The cutting system (20) may include a combination of machine direction cutting members (as shown in FIGS. 8A and 8B) or cross-machine direction cutting member (as shown in FIGS. 5A and 5B). In accordance with further aspects, the cutting members may be dynamically rotatable (about a vertical axis) between machine direction and cross-machine direction. In this way, panels of a wide variety of sizes may be processed together and easily separated.

Figure 11:
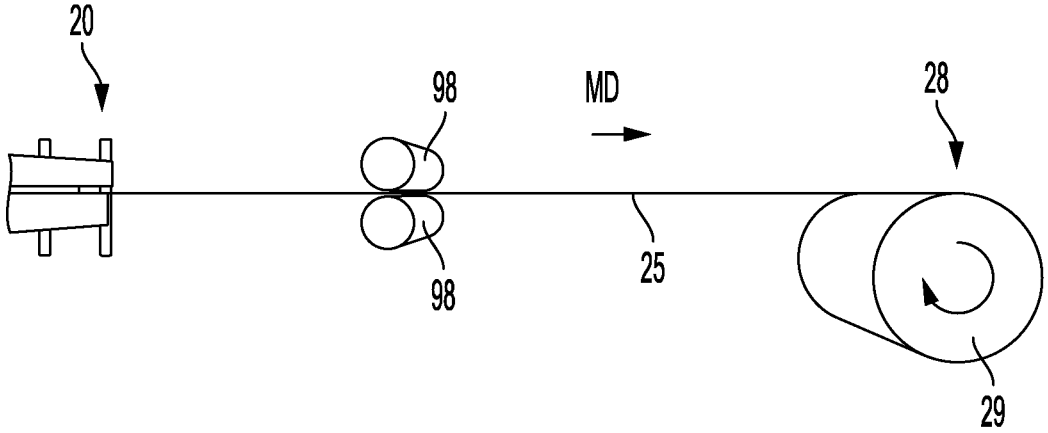
FIG. 11 shows an illustrative diagrammatic view of the system of FIG. 1 showing the rotating collection roller.

FIG. 11 shows the Wire Mesh (25) being brought along in the machine direction by the advancing system (27) that includes one or more transport mechanisms. The input station (12) (as shown in FIGS. 1, 2A and 2B) may also include one or more drive rollers for moving the Wire Mesh through the wire processing system (10) (as shown in FIG. 1). At the receiving area (28), the processed Wire Mesh may be collected in a variety of forms, including collected on a rotating collection roller (29).

Figure 12:
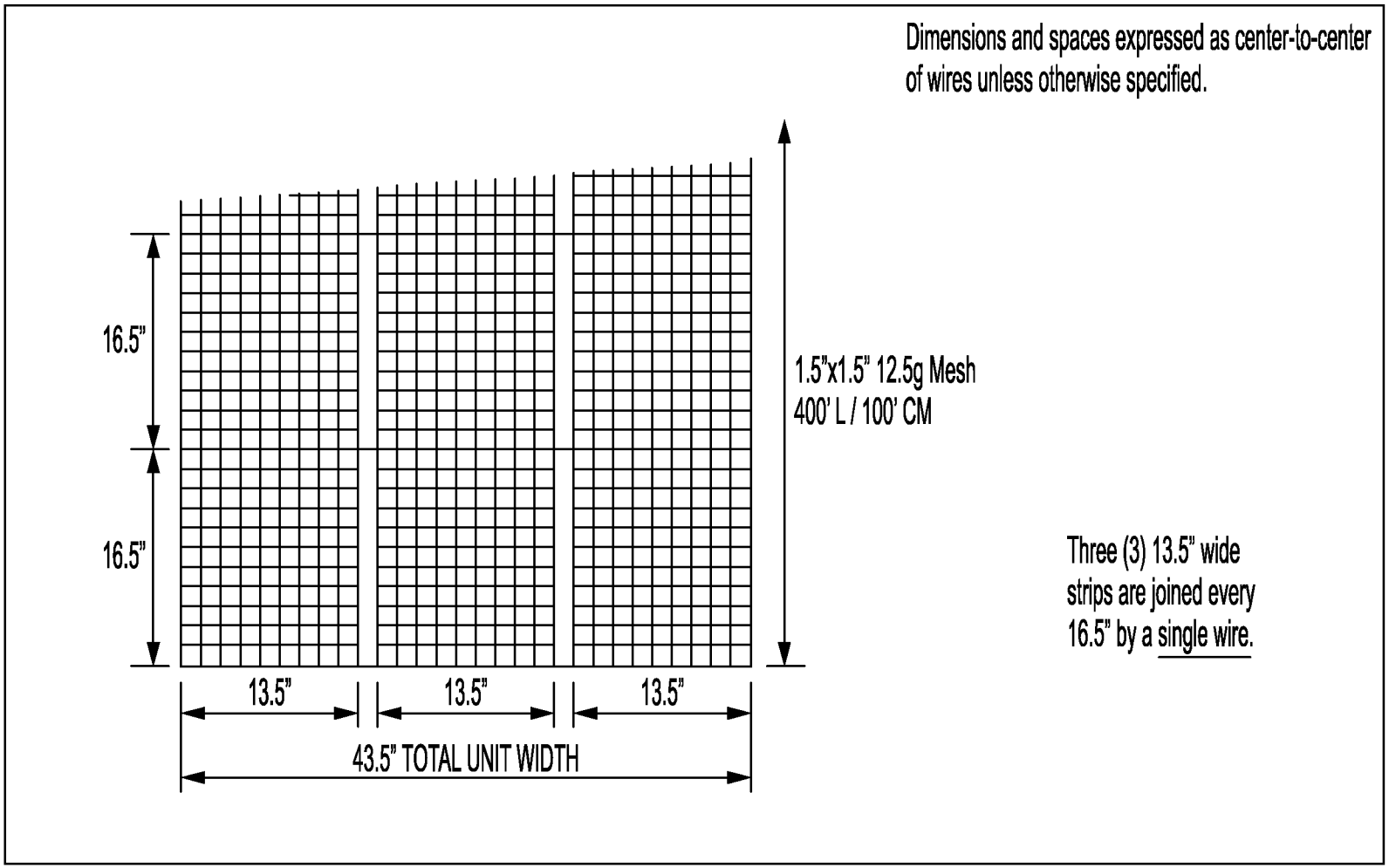
FIG. 12 shows an illustrative graphical representation of a wire mesh formed in accordance with an aspect of the present invention that includes three 13.5" wide strips joined by a single wire.
Figure 13:
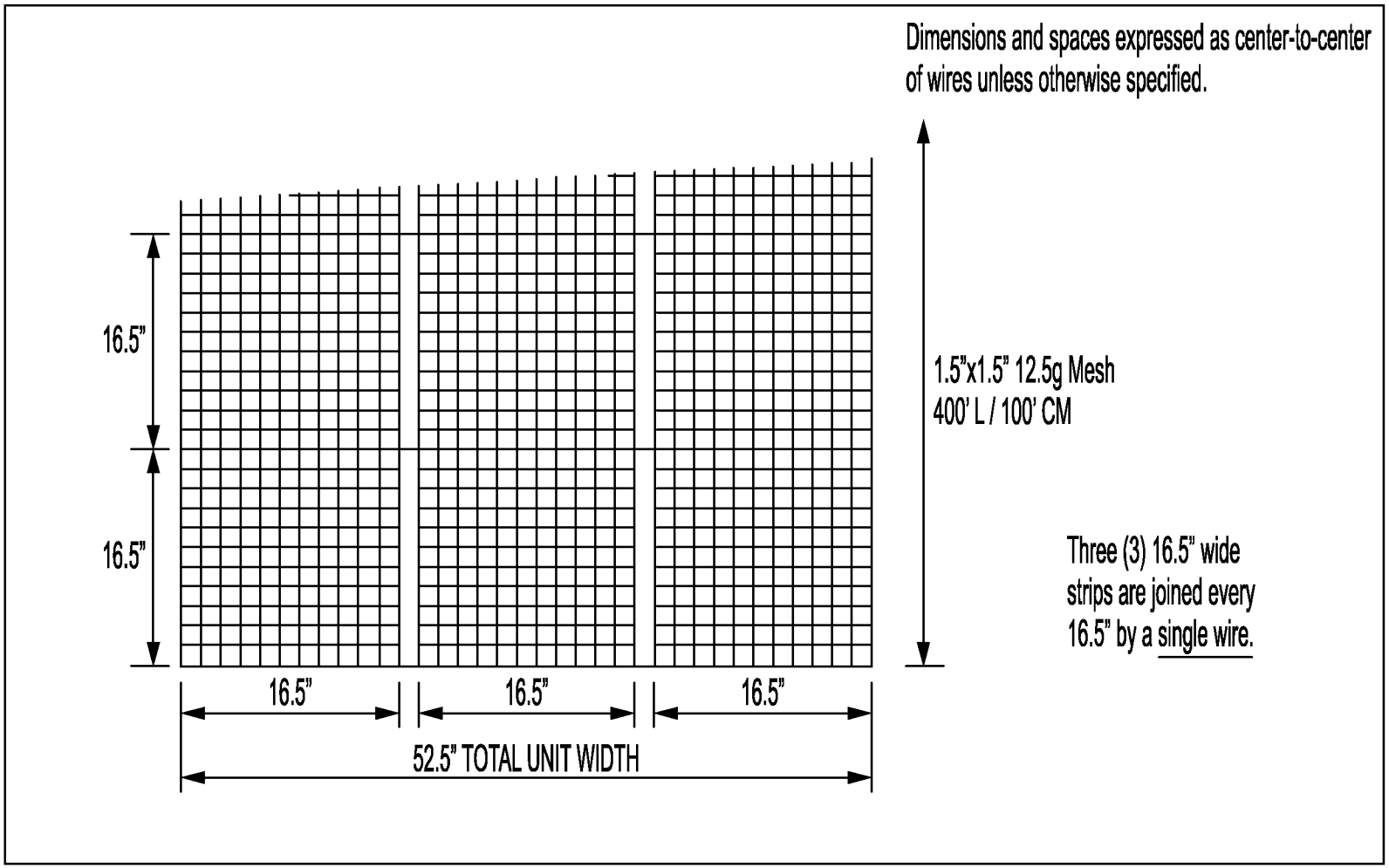
FIG. 13 shows an illustrative graphical representation of a wire mesh formed in accordance with an aspect of the present invention that includes three 16.5" wide strips joined by a single wire.
Figure 14:
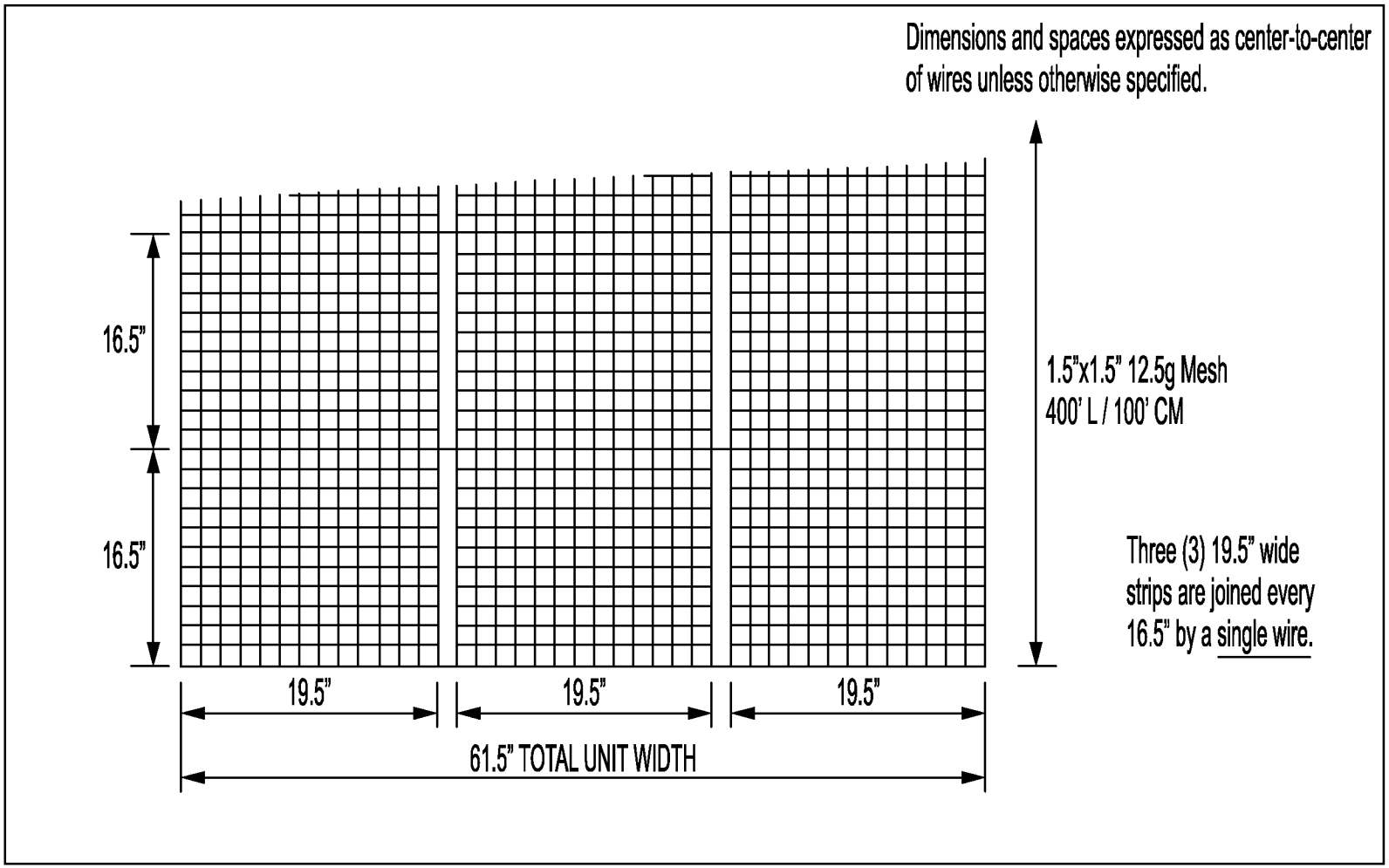
FIG. 14 shows an illustrative graphical representation of a wire mesh formed in accordance with an aspect of the present invention that includes three 19.5" wide strips joined by a single wire.

FIGS. 12, 13, and 14 show various examples of specific connected panels processed in accordance with the various aspects of the present invention. FIG. 12 shows an illustrative graphical representation of a wire mesh formed in accordance with an aspect of the present invention that includes three 13.5" wide strips joined by a single wire. FIG. 13 shows an illustrative graphical representation of a wire mesh formed in accordance with an aspect of the present invention that includes three 16.5" wide strips joined by a single wire. FIG. 14 shows an illustrative graphical representation of a wire mesh formed in accordance with an aspect of the present invention that includes three 19.5" wide strips joined by a single wire.

The wire-mesh is therefore formed of wires in a warp direction bonded to wires in a fill direction that is mutually orthogonal with respect to the warp direction. The wire-mesh includes at least one gap that extends in any of the warp direction or the fill direction, the gap being formed of mutually-contiguous breaks in any of the warp direction wires and the fill direction wires. As discussed above, the gap facilitates separation of the wire mesh. In particular, the panels may be readily separated by cutting the uncut wire strands (48 and 68) (as shown in FIGS. 6 and 7, and FIGS. 9 and 10, respectively). The selective cutting of the wire mesh therefore provides gaps that facilitate separation of the wire mesh as only a small number of bridges (e.g., strands 48, 68) remain to be cut following processing. The wire-mesh may include a plurality of gaps, and the plurality of gaps may run in any of the warp and fill direction or both the warp and fill directions.

Those skilled in the art will appreciate that numerous modifications and variations may be made to the above disclosed embodiments without departing from the spirit and scope of the present invention.

What is claimed is:

1. A wire-mesh formed of wires in a warp direction bonded to wires in a fill direction that is mutually orthogonal with respect to the warp direction, wherein the wire-mesh includes at least one gap that extends in any of the warp direction or the fill direction to define at least one panel, the gap comprising a series of sequential and adjacent breaks in any of the warp direction wires and the fill direction wires, the at least two series of sequential and adjacent breaks being separated by a retained wire for facilitating handling of the wire mesh while permitting separation of the panel from the wire-mesh.

2. The wire-mesh as claimed in claim 1, wherein the gap runs in the warp direction.

3. The wire-mesh as claimed in claim 1, wherein the gap runs in the fill direction.

4. The wire-mesh as claimed in claim 1, wherein the at least one panel is further defined by a plurality of sets of sequential and adjacent breaks in any of the warp direction wires and the fill direction wires, each of the sets of sequential and adjacent breaks being separated by a further retained wire.

5. The wire-mesh as claimed in claim 4, wherein the plurality of sets of sequential and adjacent breaks run in the warp direction.

6. The wire-mesh as claimed in claim 4, wherein the plurality of sets of sequential and adjacent breaks run in the fill direction.

7. The wire-mesh as claimed in claim 4, wherein the plurality of sets of sequential and adjacent breaks run in both the warp and fill directions.

8. The wire-mesh as claimed in claim 1, wherein the wire-mesh is provided as a panel.

9. The wire-mesh as claimed in claim 1, wherein the wire-mesh is provided in roll form.

10. A wire-mesh formed by the method of:

receiving a plurality of line wires in a machine direction;

providing a cross wire to a welding station in a cross-machine direction;

welding the cross wire to the plurality of line wires, forming a wire-mesh;

advancing the wire-mesh in the machine direction, providing that additional cross wires may be introduced to the wire-mesh and welded at the welding station;

selectively cutting a plurality of adjacently sequential wires in any of the machine direction or the cross-machine direction separated by a retained wire in the wire-mesh as it moves in the machine direction, the plurality of cuts demarking distinct panels of wire mesh; and separating the wire-mesh into the distinct panels by breaking the retained wire.

11. The wire-mesh as claimed in claim 10, wherein the distinct panels are further defined by a plurality of sets of sequential and adjacent breaks in any of the machine direction wires and the cross-machine direction wires, each of the sets of sequential and adjacent breaks being separated by a further retained wire.

12. The wire-mesh as claimed in claim 11, wherein the plurality of sets of sequential and adjacent breaks run in the machine direction.

13. The wire-mesh as claimed in claim 11, wherein the plurality of sets of sequential and adjacent breaks run in the cross-machine direction.

14. The wire-mesh as claimed in claim 11, wherein the plurality of sets of sequential and adjacent breaks run in both the warp and fill directions.

15. The wire-mesh as claimed in claim 10, wherein the wire-mesh is provided as a panel.

16. The wire-mesh as claimed in claim 10, wherein the wire-mesh is provided in roll form.

* * * * *